US005887220A

United States Patent [19]

Nagaoka

[11] Patent Number: 5,887,220

[45] Date of Patent: Mar. 23, 1999

[54] ELECTROPHOTOGRAPHIC PRINTER SENSING AMBIENT CONDITIONS WITHOUT SENSORS

[75] Inventor: Kazuhiko Nagaoka, Tokyo, Japan

[73] Assignee: Oki Data Corporation, Tokyo, Japan

[21] Appl. No.: 61,158

[22] Filed: Apr. 16, 1998

[30] Foreign Application Priority Data

Apr. 23, 1997 [JP] Japan ..... 9-120210

[51] Int. Cl.[6] ..... G03G 15/00

[52] U.S. Cl. ..... 399/46; 399/43; 399/45; 399/50; 399/55; 399/66; 399/69

[58] Field of Search ..... 399/43, 45, 46, 399/50, 55, 66, 67, 69, 97, 26, 31

[56] References Cited

U.S. PATENT DOCUMENTS 4,857,959 8/1989 Shimbo et al. ..... 399/66
5,151,736 9/1992 Ohzeki et al. .
5,621,504 4/1997 Wakamatsu et al. .
5,682,575 10/1997 Komori ..... 399/66
5,809,367 9/1998 Yoo et al. ..... 399/66 X

FOREIGN PATENT DOCUMENTS 0 647 889 A1 4/1995 European Pat. Off. .
07168467 7/1995 Japan .

*Primary Examiner*—Matthew S. Smith
*Attorney, Agent, or Firm*—Panitch Schwarze Jacobs & Nadel, P.C.

[57] ABSTRACT

When an electrophotographic printer is manufactured, the initial electrical resistance of its transfer roller is measured and a corresponding value is stored in a memory device in the printer. During operation, the printer's control program estimates the resistance of the transfer roller from the stored value, taking aging into account, then measures the actual resistance of the transfer roller, and infers ambient conditions from the difference between the estimated and actual resistance values. The electrophotographic printer is controlled according to the inferred ambient conditions.

18 Claims, 12 Drawing Sheets

| RANK | INITIAL RESISTANCE | Rst (Ω) |
|---|---|---|
| 1 | 0.30E+08< = <0.35E+08 | 1.00E+07 |
| 2 | 0.35E+08< = <0.40E+08 | 1.50E+07 |
| 3 | 0.40E+08< = <0.45E+08 | 2.00E+07 |
| 4 | 0.45E+08< = <0.50E+08 | 2.50E+07 |
| ⋮ | ⋮ | ⋮ |
| 13 | 0.90E+08< = <0.95E+08 | 7.00E+07 |
| 14 | 0.95E+08< = <1.00E+08 | 7.50E+07 |

FIG.10

| Rsf | TRANSFER VOLTAGE [V] |
|---|---|
| -50% | Vtr+100 |
| -50%～-25% | Vtr+200 |
| -25%～+25% | Vtr+300 |
| +25%～+50% | Vtr+400 |
| +50%～+75% | Vtr+450 |
| +75%～+100% | Vtr+550 |
| +100% | Vtr+600 |

FIG.11

| Rsf | TRANSFER VOLTAGE [V] | | |
|---|---|---|---|
| | MEDIA A | MEDIA B | MEDIA C |
| -50% | Vtr+0 | Vtr+280 | Vtr+500 |
| -50%～-25% | Vtr+50 | Vtr+300 | Vtr+500 |
| -25%～+25% | Vtr+150 | Vtr+320 | Vtr+500 |
| +25%～+50% | Vtr+250 | Vtr+340 | Vtr+500 |
| +50%～+75% | Vtr+350 | Vtr+360 | Vtr+500 |
| +75%～+100% | Vtr+450 | Vtr+380 | Vtr+500 |
| +100% | Vtr+550 | Vtr+400 | Vtr+500 |

FIG.15

| Rsf | CHARGING VOLTAGE [V] |
|---|---|
| -50% | -1250 |
| -50%～-25% | -1300 |
| -25%～+25% | -1350 |
| +25%～+50% | -1400 |
| +50%～+75% | -1450 |
| +75%～+100% | -1500 |
| +100% | -1550 |

FIG.16

| Rsf | VOLTAGE [V] | |
|---|---|---|
| | DEVELOPING ROLLER | SUPPLY ROLLER |
| -50% | -250 | -400 |
| -50%～-25% | -275 | -425 |
| -25%～+25% | -300 | -450 |
| +25%～+50% | -325 | -475 |
| +50%～+75% | -350 | -500 |
| +75%～+100% | -375 | -525 |
| +100% | -400 | -550 |

FIG.17

| Rsf | FUSING TEMPERATURE [℃] | | |
|---|---|---|---|
| | MEDIA A | MEDIA B | MEDIA C |
| -50% | 130 | 150 | 170 |
| -50%～-25% | 140 | 160 | 180 |
| -25%～+25% | 150 | 170 | 190 |
| +25%～+50% | 160 | 170 | 190 |
| +50%～+75% | 160 | 170 | 190 |
| +75%～+100% | 160 | 170 | 190 |
| +100% | 160 | 170 | 190 |

| Rsf | DISCHARGING VOLTAGE [V] |
|---|---|
| -50% | 1500 |
| -50%～-25% | 1000 |
| -25%～+25% | 500 |
| +25%～+50% | 0 |
| +50%～+75% | 0 |
| +75%～+100% | 0 |
| +100% | 0 |

ELECTROPHOTOGRAPHIC PRINTER SENSING AMBIENT CONDITIONS WITHOUT SENSORS

BACKGROUND OF THE INVENTION

The present invention relates to an electrophotographic printer, more particularly to an improved method of controlling an electrophotographic printer.

Widely used in copiers, facsimile machines, and computer systems, electrophotographic printers have a photosensitive drum that is illuminated to form a latent image. The latent image is developed by application of toner, which is then transferred to printing media, such as paper, passing between the photosensitive drum and a transfer roller. The toner adheres to the photosensitive drum because of electrostatic attraction, and is also transferred by electrostatic attraction to the printing media.

A major factor determining the quality of the printed image is the transfer current flux between the surface of the photosensitive drum and the interior of the transfer roller. If the transfer current is too weak, the transferred image will be faint or patchy. If the transfer current is too strong, electrostatic forces may scatter toner particles on the paper, creating a fuzzy image. The transfer current is affected by ambient conditions such as temperature and humidity, which alter the moisture content and hence the electrical resistance of the printing media and transfer roller, and must be regulated by, for example, adjusting the transfer voltage applied to the roller.

One conventional method of adjusting the transfer voltage measures the combined electrical resistance of the printing media and transfer roller at the instant when the front edge of a page is caught by the transfer roller, and adjusts the transfer voltage according to the measured resistance. A problem with this method is that the high-voltage power supply that generates the transfer voltage has a limited response speed, so in high-speed printing, the transfer voltage cannot be adjusted quickly enough to prevent degradation of the image at the top of the page.

Another conventional method equips the printer with a temperature-humidity sensor, and sets the transfer voltage to a value determined from the ambient temperature and humidity. One problem with this method is the high cost of the sensor. Another problem is that the inherent electrical resistance of the transfer roller varies from one manufactured lot of rollers to another, and also changes over the life of the printer, making it difficult to determine the correct transfer voltage from ambient conditions alone.

To complicate the problem, an electrophotographic printer has other components that are affected by ambient conditions and require adjustment of applied voltages.

SUMMARY OF THE INVENTION

It is accordingly an object of the present invention to set correct transfer conditions in an electrophotographic printer, starting even before the feeding of printing media to the transfer roller, without requiring an additional sensor to sense ambient conditions.

Another object of the invention is to control the charging voltage applied to the charging roller according to ambient conditions, without requiring an additional sensor.

Another object is to control the developing voltage according to ambient conditions, without requiring an additional sensor.

Another object is to control the fusing temperature according to ambient conditions, without requiring an additional sensor.

Another object is to avoid unwanted shunting of transfer current through the printing media to ground.

The invented method of controlling an electrophotographic printer comprises the steps of:

- measuring the resistance value of the transfer roller when the transfer roller is manufactured;
- storing corresponding data in a memory device in the electrophotographic printer;
- reading a counter to determine the amount of use the electrophotographic printer has received;
- calculating an estimated resistance value of the transfer roller from the stored data and amount of use;
- measuring the actual resistance value of the transfer roller under ambient conditions;
- estimating the resistance change due to the ambient conditions, by comparing the estimated resistance value and actual resistance value; and
- controlling the electrophotographic printer according to the estimated resistance change.

The step of controlling may include controlling the transfer voltage applied to the transfer roller, which is controlled according to both the estimated resistance value and estimated resistance change. The transfer voltage may also be controlled according to the type of printing media.

The charging voltage, developing voltage, fusing temperature, and printing media discharging voltage may also be controlled according to the estimated resistance change.

Comparing the estimated and actual resistance values of the transfer roller provides a way to infer ambient conditions without using a sensor. Controlling the printing media discharging voltage prevents shunting of transfer current from the transfer roller to ground.

BRIEF DESCRIPTION OF THE DRAWINGS

In the attached drawings:

FIG. 10 is a table used for controlling the transfer voltage in the first embodiment;

FIG. 11 is a table used for controlling the transfer voltage in a second embodiment;

FIG. 15 is a table used for controlling the charging voltage in a third embodiment of the invention;

FIG. 16 is a table used for controlling the developing voltage in a fourth embodiment;

FIG. 17 is a table used for controlling the fusing temperature in a fifth embodiment;

DETAILED DESCRIPTION OF THE INVENTION

Embodiments of the invention will be described with reference to the attached exemplary drawings.

Figure 1:
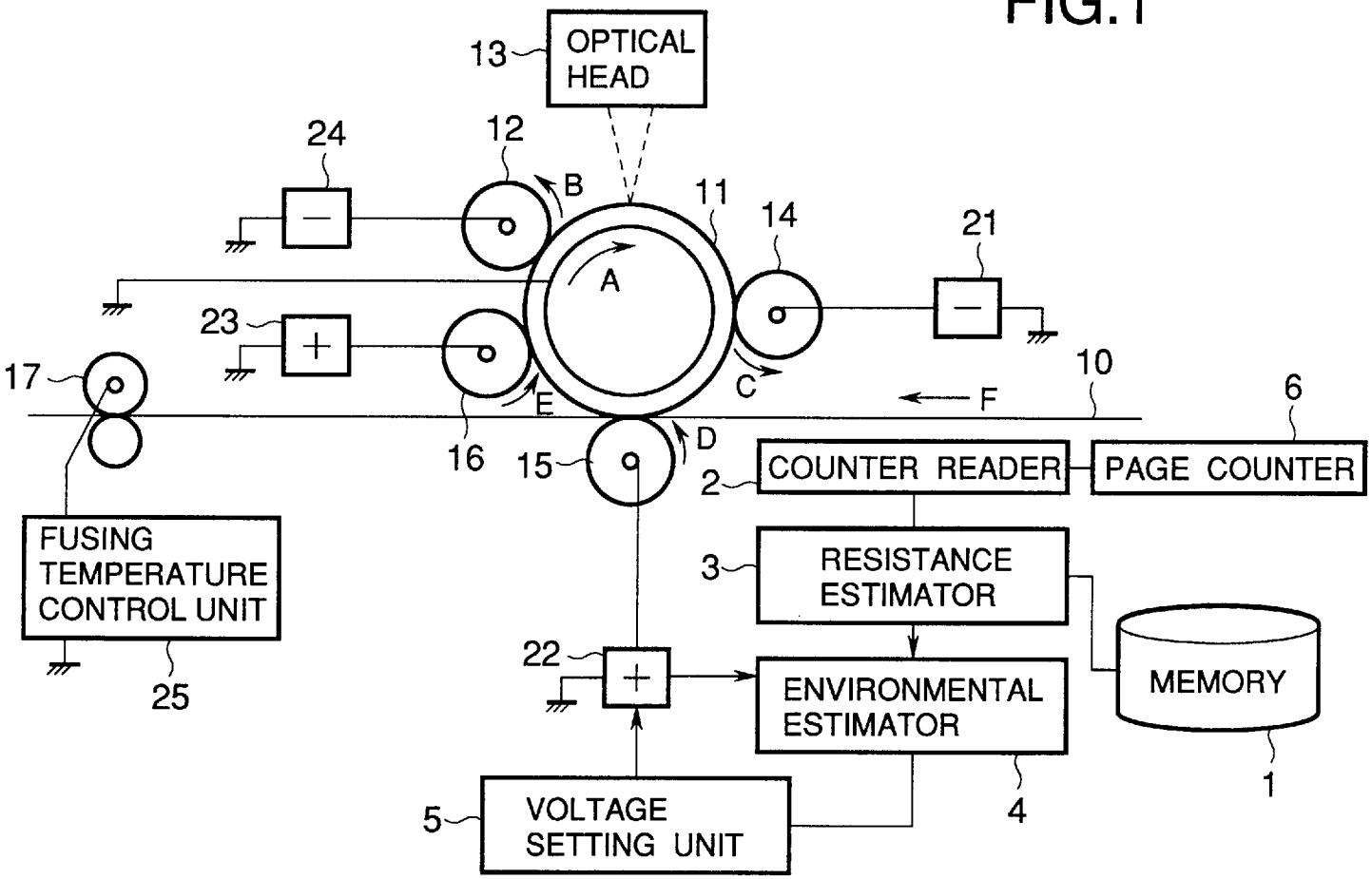
FIG. 1 is a simplified diagram of an electrophotographic printer illustrating a first embodiment of the invention.

FIG. 1 shows the relevant parts of an electrophotographic printer illustrating a first embodiment of the invention. Of particular relevance to the invention are a memory device 1, a counter reader 2, a resistance estimator 3, an environmental estimator 4, and a voltage setting unit 5, which are part of the printer's control system. The memory device 1 comprises, for example, a semiconductor memory such as an electrically erasable programmable read-only memory (EEPROM), or a mechanical memory such as a dual-in-line-pin switch or DIP switch. The counter reader 2, resistance estimator 3, environmental estimator 4, and voltage setting unit 5 are part of, for example, a microcontroller or microprocessor system that controls the operation of the printer.

The other elements in FIG. 1 are found in electrophotographic printers in general. A page counter 6 counts the total number of pages printed by the printer, starting from the time when the printer was manufactured. In conventional printers, the total cumulative page count is used to determine the amount of use the printer has received and estimate when parts of the printer should be replaced.

During the printing process, a photosensitive drum 11 is uniformly charged by a charging roller 12, then illuminated by an optical image-writing head 13 to form a latent electrostatic image, which is developed by application of toner from a developing roller 14. The image is transferred to paper 10 or other printing media by a transfer roller 15, after which the toner that still adheres to the photosensitive drum 11 is removed by a cleaning roller 16. The transferred image is fused onto the paper 10 by a fusing roller 17, then the printed paper is delivered to a tray (not visible).

Arrows A to E indicate the direction of rotation of the photosensitive drum 11 and rollers 12, 14, 15, and 16. The rollers turn in contact with the photosensitive drum 11, following the rotation of the drum and applying a certain pressure to the drum surface. Arrow F indicates the direction of travel of the paper 10.

The printer also has several power supply units that generate high positive and negative voltages that are applied to the above-mentioned rollers. The power supply units include a developing power supply 21, a transfer power supply 22, a cleaning power supply 23, a charging power supply 24, and a fusing power supply or fusing temperature control unit 25, which senses the temperature of the fusing roller 17 and feeds current to a heating element in the fusing roller 17.

Figure 2:
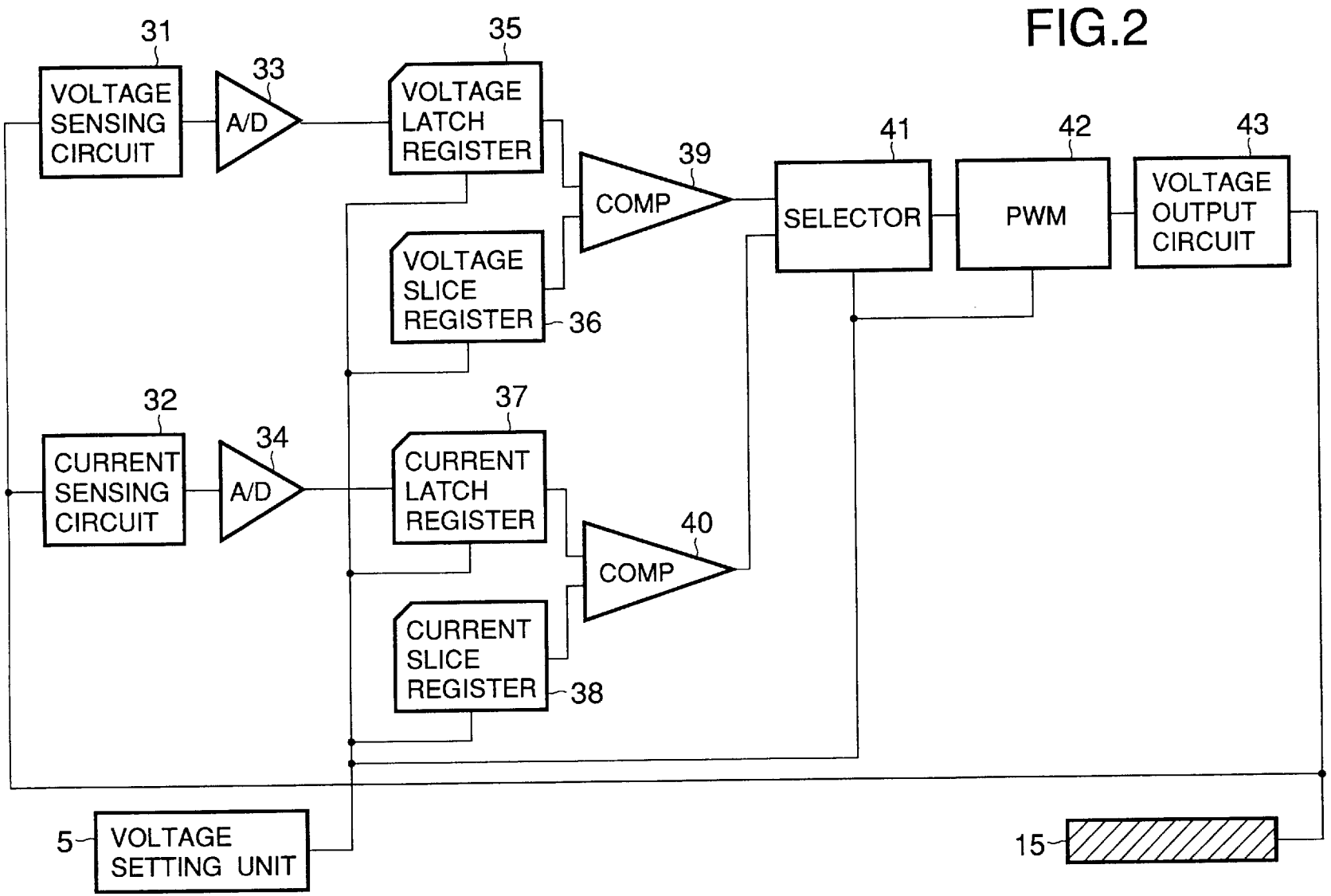
FIG. 2 is a block diagram of the transfer power supply in the first embodiment.

FIG. 2 shows the internal structure of the transfer power supply 22, also showing the voltage setting unit 5 and transfer roller 15. The transfer power supply 22 comprises a voltage sensing circuit 31, a current sensing circuit 32, a pair of analog-to-digital (A/D) converters 33 and 34, a voltage latch register 35, a voltage slice register 36, a current latch register 37, a current slice register 38, a pair of comparators (COMP) 39 and 40, a selector 41, a pulse-width modulation (PWM) circuit 42, and a voltage output circuit 43, which supplies the transfer voltage to the transfer roller 15.

The transfer voltage is controlled by the duty cycle of a PWM signal supplied from the PWM circuit 42 to the voltage output circuit 43. The duty cycle of the PWM signal is adjusted according to the output of comparator 39 or comparator 40, as selected by selector 41. Comparator 39 compares the values in the voltage latch register 35 and voltage slice register 36, and outputs a signal indicating which value is higher. Comparator 40 similarly compares the values in the current latch register 37 and current slice register 38. The values in the slice registers 36 and 38 are set by the voltage setting unit 5. The values in the latch registers 35 and 37 are, respectively, the outputs of the voltage sensing circuit 31 and current sensing circuit 32, as converted to digital form by A/D converters 33 and 34. The voltage sensing circuit 31 and current sensing circuit 32 are both coupled to the power supply line joining the voltage output circuit 43 to the transfer roller 15. The voltage sensing circuit 31 senses the voltage on this line, while the current sensing circuit 32 senses the current flow.

Figures 3, 5:
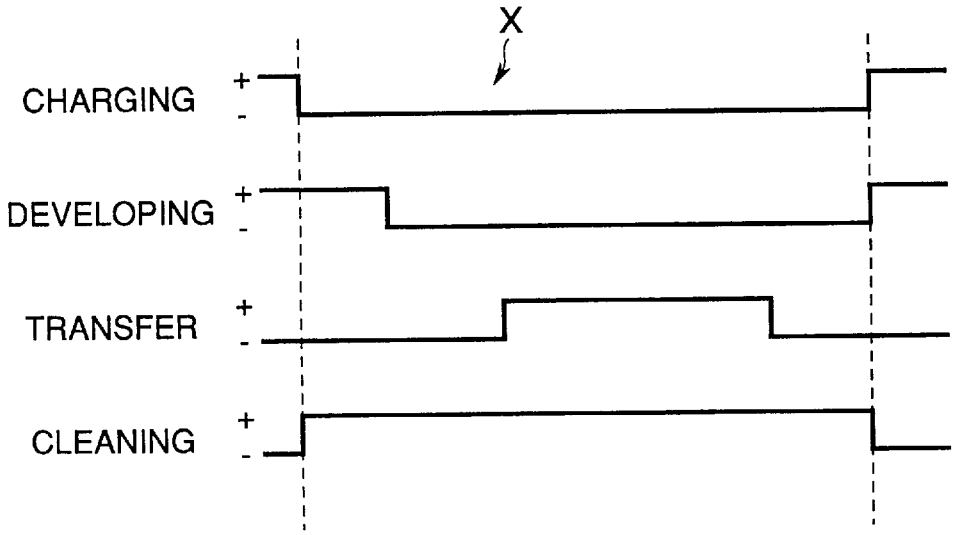
FIG. 3 is a timing diagram illustrating the operation of power supply units in the first embodiment.
FIG. 5 is a ranking table of electrical resistance values of the transfer roller in the first embodiment.

During the printing of a page, power supplies 21 to 24 generate positive and negative voltages as illustrated in FIG. 3. From the time when the photosensitive drum 11 begins turning until rotation of the photosensitive drum 11 stops, the charging power supply 24 supplies a negative voltage to the charging roller 12, and the cleaning power supply 23 supplies a positive voltage to the cleaning roller 16. The developing power supply 21 starts supplying a negative voltage to the developing roller 14 shortly after the photosensitive drum 11 begins turning, and continues supplying this negative voltage until rotation of the photosensitive drum 11 stops. Illumination of the photosensitive drum 11 begins at a point marked X, after the developing power supply 21 has been turned on. The transfer power supply 22 begins supplying a positive voltage to the transfer roller 15 at a later point, when the top edge of the page reaches the transfer roller 15, and continues supplying the positive voltage until the trailing edge of the page has passed the transfer roller 15.

Next, the operation of the first embodiment in controlling the transfer voltage will be described.

Figure 4:
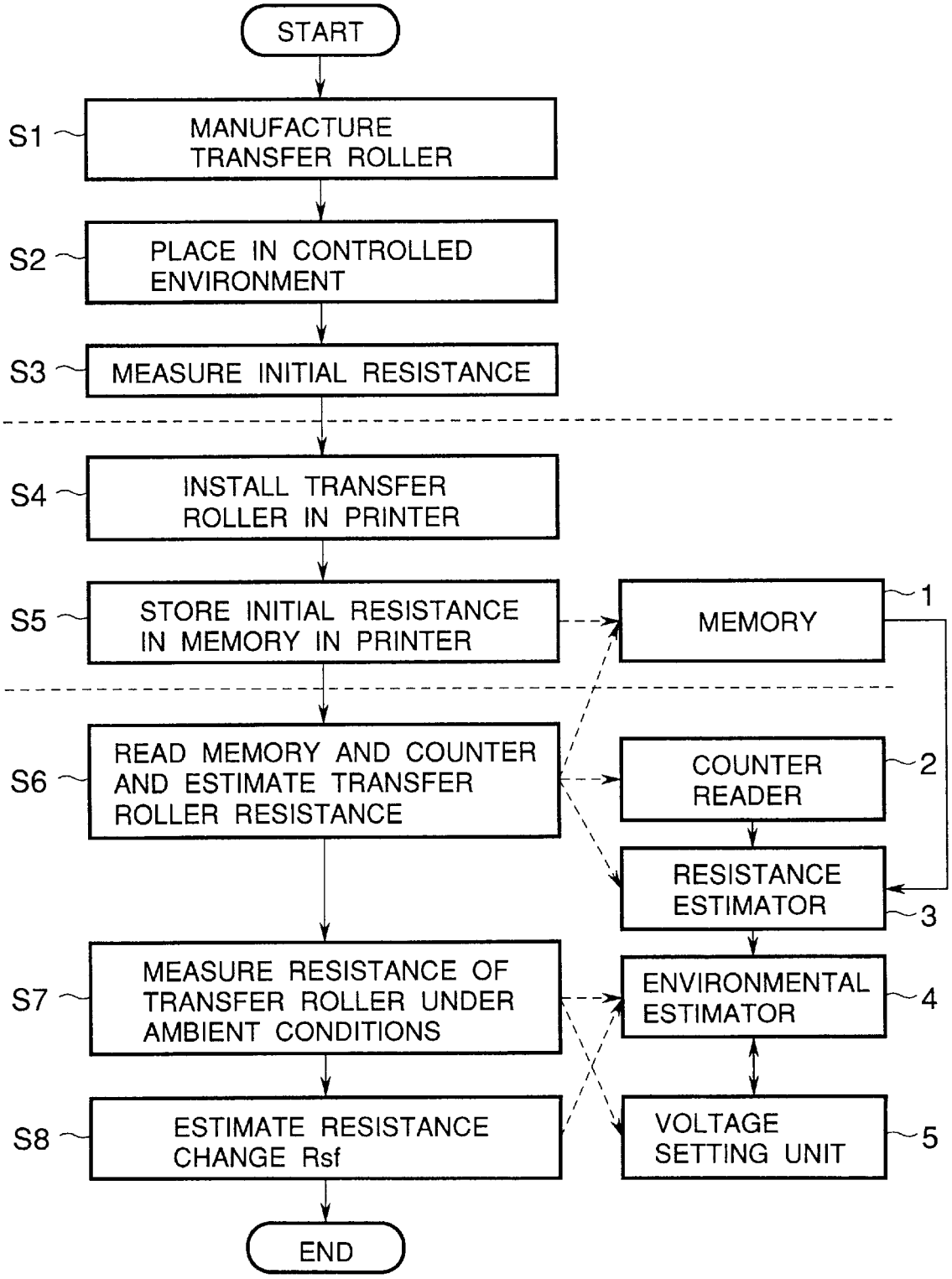
FIG. 4 is a flowchart illustrating the transfer voltage control method in the first embodiment.

FIG. 4 is a flowchart showing the transfer voltage control procedure, starting with the manufacture of the transfer roller in step S1. In step S2, the manufactured transfer roller 15 is placed in a controlled environment for a certain time, for example, in a room-temperature (20° C.) environment held at 50% relative humidity, for twenty-four hours. The time should be sufficient for the electrical resistance of the transfer roller to stabilize under the environmental conditions. Next, in step S3, the electrical resistance of the transfer roller is measured under these environmental conditions. The measured value will be referred to as the initial resistance value.

In step S4, the transfer roller 15 is installed in the electrophotographic printer. In step S5, the measured initial resistance value is stored in the memory device 1.

In this embodiment, the initial resistance value is stored in the memory device 1 as a rank or grade value. FIG. 5 shows one possible ranking scheme, with fourteen ranks, and also shows a single initial estimated value of the resistance of the transfer roller 15, under standard operating conditions, for each rank. For example, if the measured initial resistance value of the transfer roller 15 is from $0.90\times10^8$ ohms to $0.95\times10^8$ ohms, corresponding to rank thirteen, the initial estimated resistance value under standard operating conditions is $7.00\times10^7$ ohms.

Referring again to FIG. 4, steps S1 to S5 are carried out only when the printer is manufactured. Steps S6 to S8 are carried out when the printer is used. Steps S6 to S8 can be executed when the printer's power is switched on, for example, or at other suitable times.

In step S6, the rank of the transfer roller 15 is read from the memory device 1, the number of pages printed so far is read from the page counter 6, and these values are combined to derive an estimate of the electrical resistance of the transfer roller 15 at present, under standard operating conditions.

Figure 6:
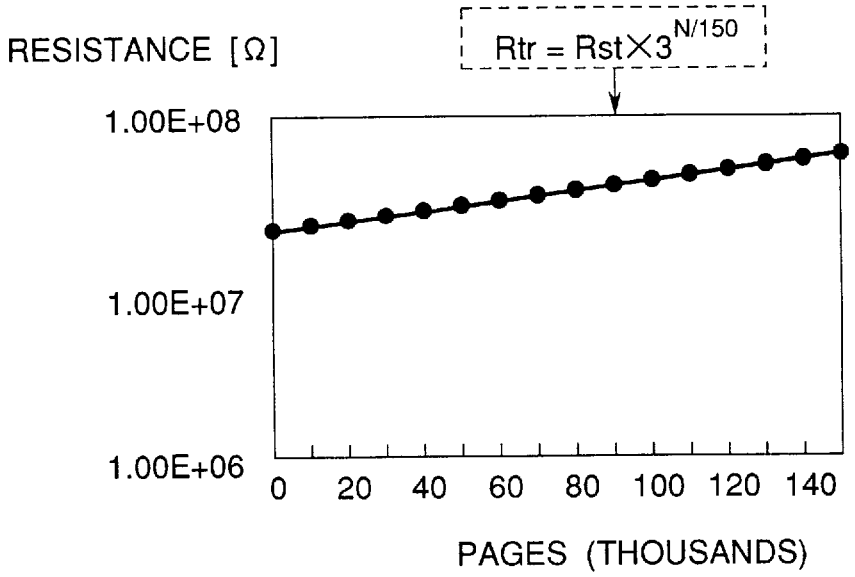
FIG. 6 is a graph illustrating aging changes of the electrical resistance of the transfer roller.

FIG. 6 shows an example of the aging changes that occur in the resistance of the type of transfer roller 15 employed in the first embodiment. The resistance value is shown on the vertical axis, measured under the same conditions as in step S3, e.g., 20° C. and 50% relative humidity. The number of printed pages is shown in thousands on the horizontal axis. If Rst denotes the initial resistance value, and Rtr denotes the resistance value after N thousand pages have been printed, these quantities are empirically found to be related as follows.

$$Rtr=Rst\times3^{(N/150)}$$

The same relationship can be assumed to hold between Rtr and Rst under standard operating conditions. The estimated resistance value is therefore obtained in the first embodiment by multiplying the initial resistance value under standard operating conditions by a correction factor of $3^{(N/150)}$. Step S6 is carried out by the counter reader 2, which reads the page count from the page counter 6 and calculates the correction factor, and by the resistance estimator 3, which reads the rank of the transfer roller 15 from the memory device 1, converts the rank to an initial estimated resistance value under standard operating conditions, and multiplies this value by the correction factor. For example, if twenty thousand pages have been printed and the rank stored in the memory device 1 is rank thirteen, then from the table in FIG. 5 and the formula given above, the estimated resistance value Rtr is calculated as follows.

$$Rtr=0.7\times10^8\times3^{20/150}=0.81\times10^8$$

The correction factor can be calculated by mathematical operations, or by interpolation from a look-up table.

In step S7, the actual resistance value of the transfer roller 15 under ambient conditions is measured. This step is carried out by the environmental estimator 4 and voltage setting unit 5, before the actual printing of pages begins.

The electrical resistance of the transfer roller 15 is measured by feeding a constant current and sensing the resulting voltage. Referring again to FIG. 2, the voltage setting unit 5 sets a value corresponding to the desired constant current in the current slice register 38, and directs the selector 41 to select the output of comparator 40. Comparator 40 compares the desired current value in the current slice register 38 with the actual current value as sensed by the current sensing circuit 32 and latched at certain intervals in the current latch register 37. The duty cycle of the PWM signal generated by the PWM circuit 42 is increased or decreased, depending on whether the actual current value is less than or greater than the desired current value. This feedback control scheme causes the transfer power supply 22 to stabilize at the desired constant current value.

When the voltage output circuit 43 has stabilized, the voltage output by the voltage output circuit 43 is sensed by the voltage sensing circuit 31, latched in the voltage latch register 35, read by the voltage setting unit 5, and furnished to the environmental estimator 4. From the voltage value read from the voltage latch register 35 and the current value set in the current slice register 38, the environmental estimator 4 calculates the actual electrical resistance Rrd of the transfer roller 15.

Referring again to FIG. 4, in step S8, the environmental estimator 4 estimates the change in the resistance of the transfer roller 15 caused by ambient conditions. The change can be estimated as a percent value Rsf by subtracting the estimated resistance Rtr from the measured resistance Rrd, dividing the difference by the estimated resistance Rtr, and multiplying by one hundred.

$$Rsf[\%]=100\times(Rrd-Rtr)/Rtr$$

Figure 7:
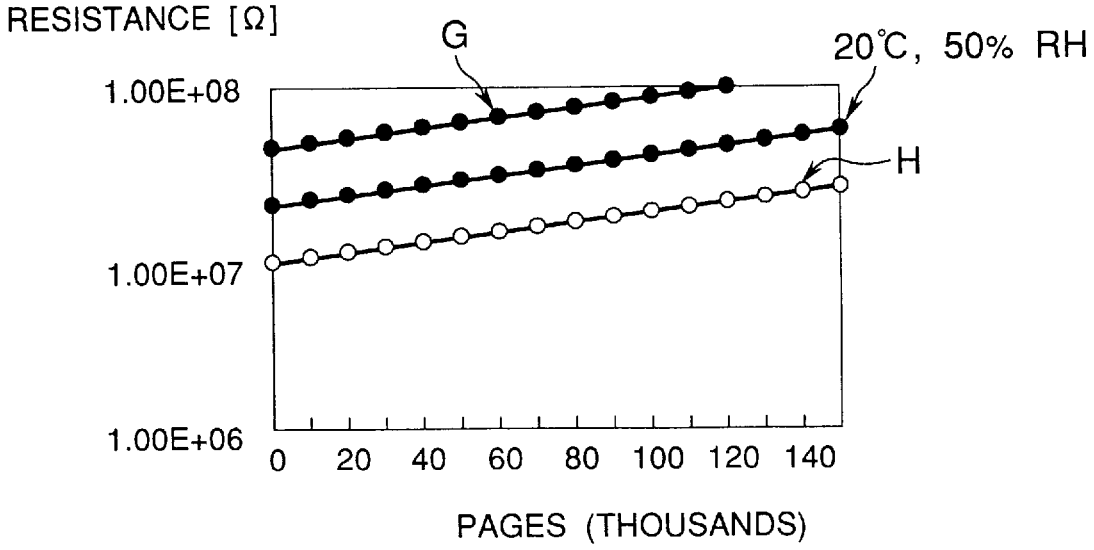
FIG. 7 is a graph illustrating these aging changes under different environmental conditions.

The electrical resistance of the transfer roller 15 depends to a considerable extent on the amount of moisture in the air, or the absolute humidity, which depends on the ambient temperature and relative humidity. FIG. 7 shows examples of resistance values for three ambient conditions: the standard conditions, e.g. 20° C. and 50% relative humidity, under which the initial resistance value was measured; conditions G with only half as much absolute humidity; and conditions H with twice as much absolute humidity. The horizontal and vertical axes have the same meanings as in FIG. 6. Under the low-humidity conditions G, the electrical resistance of the transfer roller 15 substantially doubles (Rsf=+100%). Under the high-humidity conditions H, the resistance is reduced by half (Rsf=−50%).

During printing, the transfer current depends not only on the electrical resistance of the transfer roller 15, but also on the apparent electrical resistance of the paper 10. This resistance varies with the moisture content of the paper, which varies with the absolute humidity.

Figure 8:
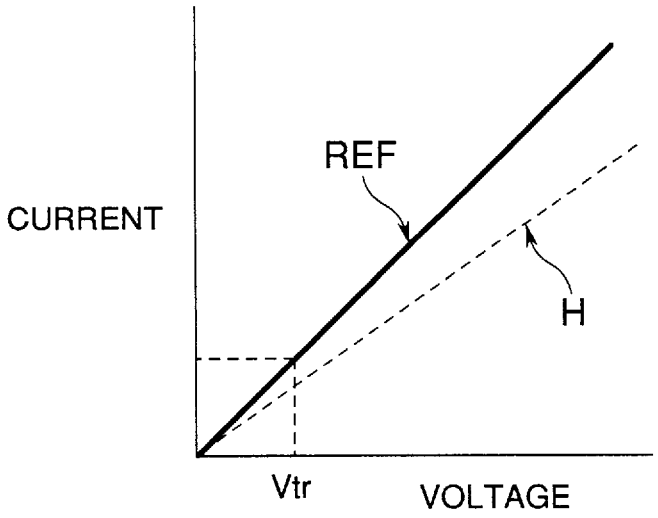
FIG. 8 is a graph of transfer current and voltage under high-humidity conditions.

FIG. 8 shows an example of the combined current-voltage characteristic of the transfer roller 15 and paper 10. The solid line is a reference characteristic (REF) for the resistance of the transfer roller 15 alone, under standard operating conditions. Vtr is a reference value of the transfer voltage, producing a desired transfer current under the standard conditions. The dotted line is the current-voltage characteristic for the combined resistance of the transfer roller 15 and paper 10 under the high-humidity condition H. Even though the resistance of the transfer roller 15 has been reduced by the elevated absolute humidity, the added resistance of the paper 10 results in less current for a given voltage.

Figure 9:
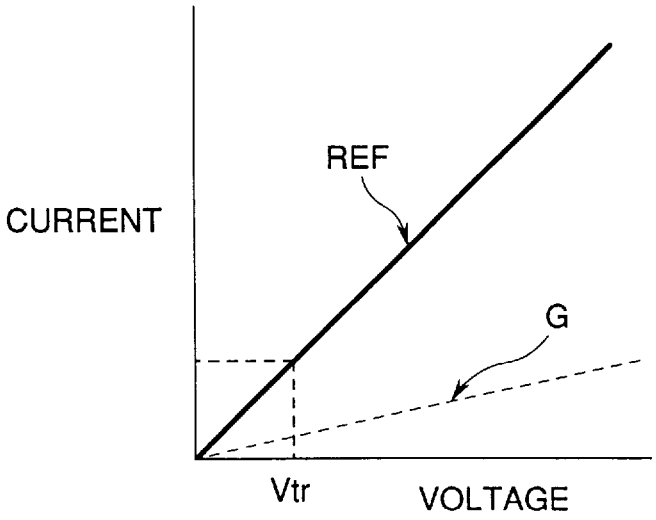
FIG. 9 is a graph of transfer current and voltage under low-humidity conditions.

FIG. 9 shows a similar characteristic for the low-humidity condition G, in which the electrical resistance of the paper 10 is greatly increased. The reference characteristic (REF) and voltage (Vtr) are the same as in FIG. 8, for standard conditions with paper absent. The combined characteristic of the transfer roller 15 and paper 10 under condition G (dotted line) shows a greatly reduced current flow, as compared with both the standard characteristic (REF) and the high-humidity characteristic H in FIG. 8.

When the environmental estimator 4 has estimated the resistance change Rsf caused by ambient conditions, the voltage setting unit 5 determines the transfer voltage that the transfer power supply 22 should generate to obtain the desired transfer current, by referring to a table like the one shown in FIG. 10. This table, which is stored in a memory area in the printer's control system, lists ranges of the estimated resistance change Rsf, and gives a transfer voltage for each range, in relation to the reference voltage Vtr. The reference voltage Vtr is calculated by the voltage setting unit 5 from the estimated resistance value Rtr obtained by the resistance estimator 3.

Having determined the desired transfer voltage, the voltage setting unit 5 sets this voltage value in the voltage slice register 36 in FIG. 2, and directs the selector 41 to select the output of comparator 39. The transfer power supply 22 then operates in a voltage feedback mode, the voltage sensing circuit 31 sensing the voltage output by the voltage output circuit 43, comparator 39 comparing this voltage with the desired voltage, and the PWM circuit 42 adjusting the duty cycle of the PWM signal according to the difference between the desired and actual voltages. The transfer power supply 22 stabilizes at the desired voltage value.

By comparing the estimated resistance value of the transfer roller 15 with the actual measured value, the environmental estimator 4 can obtain an accurate estimate of the effect of ambient conditions on electrical resistance, without the need for an expensive temperature-humidity sensor. The voltage setting unit 5 can then set an appropriate transfer voltage, taking the effect of ambient conditions on the electrical resistance of the paper 10 into account, without having to measure the combined electrical resistance of the transfer roller 15 and paper 10. The appropriate transfer voltage can thus be generated even before paper 10 is fed to the transfer roller 15. The above process is moreover independent of the printing speed of the printer. The first embodiment enables even a high-speed electrophotographic printer to deliver unblemished output from the top of the very first page.

Next, a second embodiment of the invention will be described. The second embodiment takes the differing electrical resistance characteristics of different printing media into account.

Referring to FIG. 11, the table stored in the memory of the printer's control system in the second embodiment lists the same ranges of estimated resistance change Rsf as in the first embodiment, and gives three transfer voltages for each range, corresponding to three types of printing media A, B, and C. As in the first embodiment, the transfer voltages are given in relation to a reference voltage Vtr. Before printing starts, the user designates the type of printing media to be used by, for example, pressing a button on the printer's control panel (not shown). The voltage setting unit 5 then selects the corresponding transfer voltage from the table in FIG. 11.

Other aspects of the second embodiment are the same as in the first embodiment. Steps S6 to S8 in FIG. 4 can be carried out not only at power-up, but whenever a new type of printing media is designated.

Figure 12:
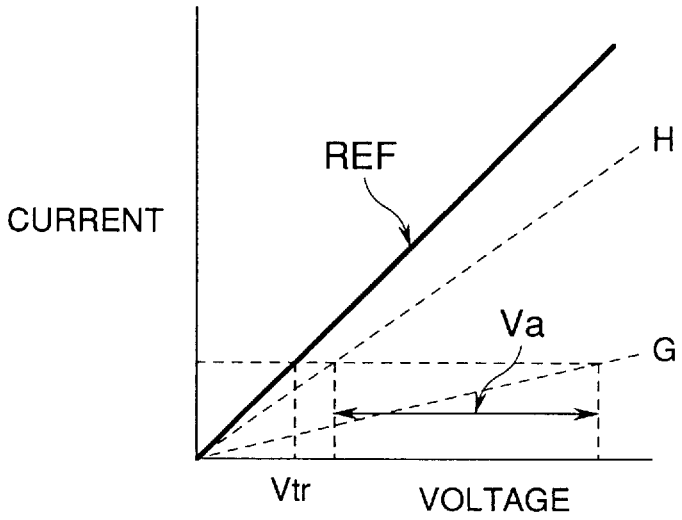
FIG. 12 is a graph of transfer current and voltage under high- and low-humidity conditions corresponding to media A in FIG. 11.

Printing media A, B, and C are, for example, plain paper, specially coated paper, and overhead-projector film. FIG. 12 shows examples of the combined resistance characteristics of the transfer roller 15 and media A under high-humidity conditions G and low-humidity conditions H. Characteristics G and H are the same as shown in FIGS. 8 and 9. The desired transfer voltages under conditions of high and low absolute humidity differ by a large amount Va.

Figure 13:
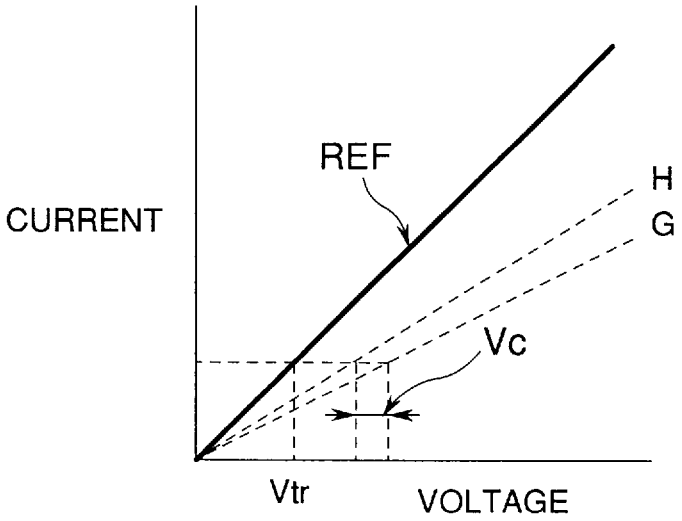
FIG. 13 is a graph of transfer current and voltage under high- and low-humidity conditions corresponding to media C in FIG. 11.

FIG. 13 shows examples of the combined resistance characteristics of the transfer roller 15 and media C under high-humidity conditions G and low-humidity conditions H. The plastic material constituting media C does not readily absorb moisture, so the desired transfer voltages now differ by only a small amount Vc. The transfer voltages given for media C in FIG. 11 are accordingly the same for all ranges of Rsf.

In its response to ambient conditions, media B is intermediate between media A and media C. A drawing will be omitted.

The second embodiment enables appropriate transfer voltages to be selected for specific printing media. The number of different types of media is of course not limited to three. For example, further categories of paper media can be provided, corresponding to different thicknesses of paper.

Next, a third embodiment will be described. The third embodiment controls the charging voltage applied to the charging roller 12, as well as the transfer voltage applied to the transfer roller 15.

The charging roller 12 comprises a conductive rubber material, the electrical resistance of which varies depending on ambient conditions. The surface of the photosensitive drum 11 is coated with, for example, an organic photosensitive material with a thickness of twenty micrometers (20 $\mu$m) and a permittivity of 3.5 $\epsilon_0$, ($\epsilon_0$ is the permittivity of the vacuum, equal to $8.855\times10^{-12}$ c/vm). To obtain good printing quality, the surface of the photosensitive drum 11 must be uniformly charged to a substantially fixed potential. If the surface potential of the drum is too high, the printing will be faint. If the surface potential is too low, the printing will be too dark, and may be fogged by the adherence of toner to non-illuminated portions of the drum surface.

Figure 14:
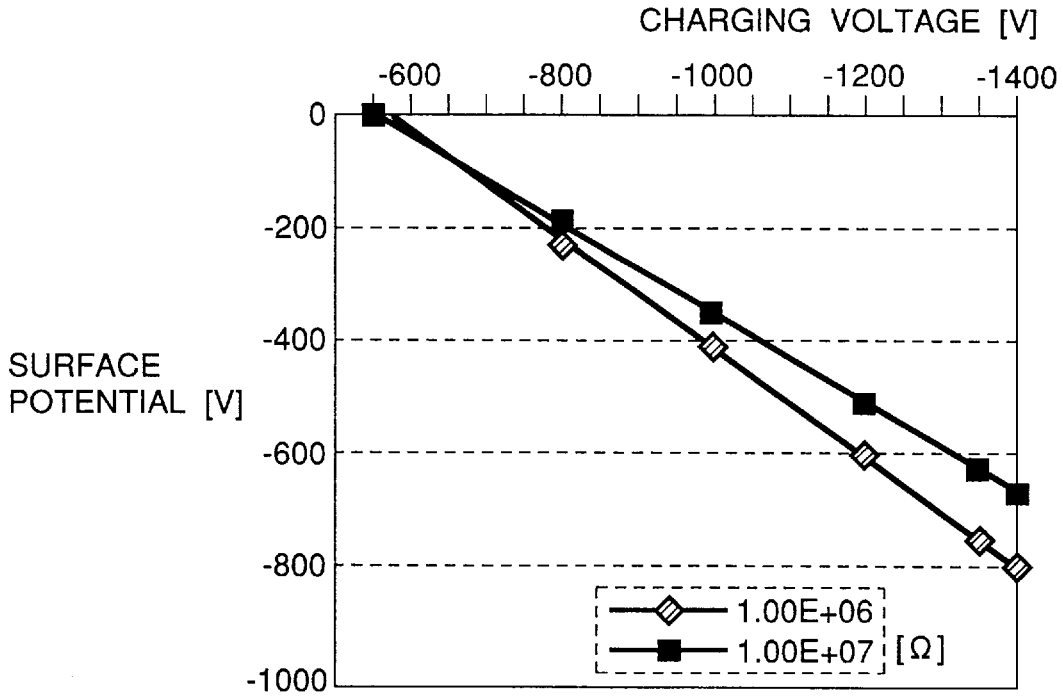
FIG. 14 is a graph of drum surface potential and charging voltage.

For a given charging voltage, however, the potential to which the surface of the drum is charged varies depending on the resistance of the charging roller 12. FIG. 14 shows an example of this effect, showing the charging voltage on the horizontal axis and the surface potential of the photosensitive drum 11 on the vertical axis. Charging characteristics are shown for charging-roller resistance values of one megohm ($1.00\times10^6$ ohms) and ten megohms ($1.00\times10^7$ ohms). The charging voltage required to obtain a given surface potential can be seen to differ depending on the resistance of the charging roller 12.

The charging power supply 24 is a comparatively simple unit designed only for constant-voltage control. Measuring the electrical resistance of the charging roller 12 every time the printer was used would require a more complex charging power supply 24, adding to the cost of the printer. Measuring the initial resistance and estimating the present resistance of the charging roller 12 from the number of printed pages would be impractical, because in many electrophotographic printers, the charging roller 12 is part of a replaceable unit including the photosensitive drum 11, and is replaced from time to time over the life of the printer. Entering the initial resistance of the new charging roller 12 every time this unit is replaced would be a troublesome and error-prone procedure.

The third embodiment accordingly adjusts the charging voltage according to the ambient conditions as inferred by the environmental estimator 4; that is, according to the estimated percent change in resistance Rsf. FIG. 15 shows an example of a table that can be stored in the printer's control system and used to determine the charging voltage.

By controlling both the transfer voltage and the charging voltage according to ambient conditions as determined by the environmental estimator 4, the third embodiment obtains further improvements in printing quality, without requiring additional measurement procedures or costly additional circuitry.

Next, a fourth embodiment will be described. Besides controlling the transfer voltage and charging voltage as in the third embodiment, the fourth embodiment controls the developing voltage applied to the developing roller 14, and the voltage applied to a sponge-rubber supply roller, not shown in the drawings, that supplies toner to the developing roller 14.

The electrical resistance of both the developing roller 14 and the supply roller varies with ambient conditions. These variations affect the charge acquired by the toner particles, hence the amount of toner transferred to the photosensitive drum 11, and can cause printing defects similar to those caused by variations in the potential of the surface of the photosensitive drum 11.

In many electrophotographic printers, the developing roller 14 and supply roller are part of the same replaceable unit as the photosensitive drum 11 and charging roller 12. The fourth embodiment accordingly adjusts the voltages applied to these two rollers by the same scheme as used to control the charging voltage in the third embodiment, by determining the voltages from the resistance change Rsf estimated by the environmental estimator 4. FIG. 16 shows an example of a table that can be stored in a memory area in the printer's control system, giving the developing voltage to be applied to the developing roller 14 and the voltage to be supplied to the supply roller.

Like the third embodiment, the fourth embodiment obtains further improvements in printing quality without requiring additional measurement procedures or circuitry, by controlling a plurality of voltages according to the ambient conditions inferred by the environmental estimator 4.

Next, a fifth embodiment will be described. The fifth embodiment also controls the temperature of the fusing roller 17 according to inferred ambient conditions.

In conventional electrophotographic printers, the fusing temperature control unit 25 is designed to hold the temperature of the fusing roller 17 at a fixed value, regardless of ambient conditions. Ambient conditions affect the fusing process, however. Low ambient temperature can lead to inadequate fusing. High ambient humidity can cause the paper to wrinkle or curl.

These environmental effects differ for different types of printing media. The fifth embodiment accordingly controls the fusing temperature according to a table such as the one shown in FIG. 17, giving different desired fusing temperatures for different types of printing media for each range of the resistance change Rsf estimated by the environmental estimator 4. Media A, B, and C in FIG. 17 are the same as media A, B, and C in FIG. 11 in the second embodiment.

By avoiding problems such as inadequate fusing and wrinkled or curled pages, the fifth embodiment can significantly improve the quality of printing, without requiring an additional temperature-humidity sensor.

Next, a sixth embodiment will be described.

Figures 18, 19:
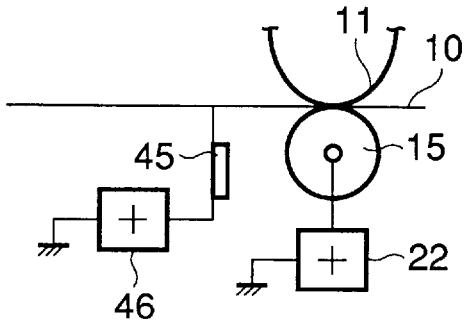
FIG. 18 is a schematic diagram of the discharging unit in a sixth embodiment.
FIG. 19 is a table used for controlling the discharging voltage in the sixth embodiment.

Referring to FIG. 18, an electrophotographic printer has, in addition to the components shown in FIG. 1, a discharging unit 45 disposed downstream of the transfer roller 15 on the paper transport path. The purpose of the discharging unit 45 is to discharge the paper 10 (or other printing media), so that the paper 10 will not stick to the photosensitive drum 11 due to electrostatic attraction, and so that the paper 10 can be transported without problems to the fusing roller 17.

In conventional electrophotographic printers, the discharging unit 45 is a simple ground connection, allowing charge to escape from the paper 10 to ground. Under high-humidity conditions, however, the combination of the reduced electrical resistance of the paper 10 and the large potential difference between the transfer roller 15 and ground may cause a substantial shunting of current from the transfer roller 15 through the paper 10 to the discharging unit 45, in which case inadequate transfer current is obtained and toner transfer problems occur.

The sixth embodiment accordingly provides an additional discharging power supply 46 that alters the potential of the discharging unit 45 according to ambient conditions as inferred by the environmental estimator 4, using a table stored in a memory area in the printer's control system. FIG. 19 shows an example of the contents of this table. Under ambient conditions that increase the resistance of the paper, the discharging unit 45 is left at ground potential. Under other conditions, the discharging power supply 46 supplies a positive discharging voltage to the discharging unit 45, to reduce the potential difference between the transfer roller 15 and discharging unit 45. The discharging voltage is raised with decreasing resistance of the paper 10.

Although not shown in FIG. 19, the discharging potential is preferably varied according to the type of printing media, in the same way as the transfer voltage is varied in the second embodiment.

By adding a discharging power supply 46, and controlling the discharging power supply 46 according to the Rsf value determined by the environmental estimator 4, the sixth embodiment enhances the effect of the first embodiment by reducing unwanted shunting of transfer current, without requiring extra sensors, and without requiring actual measurement of the electrical resistance of the paper 10.

The voltages given in FIGS. 10, 11, 15, 16, and 19 and the temperatures given in FIG. 17 can be determined by experimentation on a prototype printer, at the stage when the printer's control program is being coded. The invention is of course not limited to the values shown in these drawings.

Control of the transfer conditions is not limited to control of the transfer voltage. For example, the transfer conditions can be controlled by controlling the mutual nip or bit of the transfer roller and photosensitive drum according to the sensed ambient conditions, or by controlling the printing speed according to the sensed ambient conditions.

The embodiments described above can be varied in other ways as well. For example, the page counter may count the number of rotations of the photosensitive drum instead of the number of pages printed.

Those skilled in the art will recognize that still further variations are possible within the scope of the invention as claimed below.

What is claimed is:

1. A method of controlling an electrophotographic printer having a photosensitive drum, a transfer roller for transferring toner from the photosensitive drum to printing media, and a counter for counting an amount of use received by the electrophotographic printer, comprising the steps of:

(a) measuring an initial resistance value of said transfer roller under controlled environmental conditions, when said electrophotographic printer is manufactured;

(b) storing data corresponding to said initial resistance value in a memory device in said electrophotographic printer;

(c) reading said counter to determine the amount of use said electrophotographic printer has received since being manufactured;

(d) calculating, from the data stored in said memory device and said amount of use, an estimated resistance value of said transfer roller under standard operating conditions;

(e) measuring an actual resistance value of said transfer roller under ambient conditions, by supplying power to said transfer roller from a power supply in said electrophotographic printer;

(f) determining from said actual resistance value and said estimated resistance value an estimated resistance change due to said ambient conditions; and (g) controlling said electrophotographic printer according to said estimated resistance change.

2. The method of claim 1, wherein said step (g) includes controlling a transfer voltage supplied to said transfer roller, said transfer voltage being controlled according to both said estimated resistance change and said estimated resistance value.

3. The method of claim 2, wherein said step. (g) further comprises the steps of:

designating a type of said printing media; and controlling said transfer voltage according to the designated type of printing media.

4. The method of claim 1, wherein said electrophotographic printer also has a charging roller for applying a uniform potential to said photosensitive drum, and said step (g) includes controlling a charging voltage supplied to said charging roller according to said estimated resistance change.

5. The method of claim 1, wherein said electrophotographic printer also has a developing roller for applying said toner to said photosensitive drum, and said step (g) includes controlling a developing voltage supplied to said developing roller according to said estimated resistance change.

6. The method of claim 1, wherein said electrophotographic printer also has a fusing roller for fusing said toner to said printing media, and said step (g) includes controlling a temperature of said fusing roller according to said estimated resistance change.

7. The method of claim 6, wherein said step (g) further comprises the steps of:

designating a type of said printing media; and controlling the temperature of said fusing roller according to the designated type of printing media.

8. The method of claim 1, wherein said electrophotographic printer also has a discharging unit for discharging said printing media after transfer of said toner from said photosensitive drum, and said step (g) includes controlling a discharging voltage supplied to said discharging unit according to said estimated resistance change.

9. The method of claim 8, wherein said step (g) further comprises the steps of:

designating a type of said printing media; and controlling said discharging voltage according to the designated type of printing media.

10. An electrophotographic printer having a photosensitive drum, a transfer roller for transferring toner from the photosensitive drum to printing media, a transfer power supply for supplying a transfer voltage to the transfer roller, and a counter for counting an amount of use received by the electrophotographic printer, comprising:

a memory device storing a value corresponding to an initial resistance value of said transfer roller measured when said electrophotographic printer was manufactured;

a counter reader for reading said counter and determining the amount of use received by said electrophotographic printer since said electrophotographic printer was manufactured;

a resistance estimator coupled to said memory device and said counter reader, for calculating an estimated resistance value of said transfer roller from the value stored in said memory device and the amount of use indicated by said counter, said estimated resistance value being estimated according to standard operating conditions;

an environmental estimator coupled to said resistance estimator, for measuring the actual electrical resistance of said transfer roller under ambient conditions, comparing said actual electrical resistance with said estimated resistance value, and thereby obtaining an estimated resistance change caused by said ambient conditions; and a control system coupled to said environmental estimator, for controlling said electrophotographic printer according to said estimated resistance change.

11. The electrophotographic printer of claim 10, wherein said control system determines, from said estimated resistance value and said estimated resistance change, the transfer voltage to be supplied by said transfer power supply to said transfer roller.

12. The electrophotographic printer of claim 11, wherein said control system determines different transfer voltages for different types of said printing media.

13. The electrophotographic printer of claim 10, also comprising:

a charging roller for charging said photosensitive drum to a uniform potential; and a charging power supply coupled to said charging roller, for supplying to said charging roller a charging voltage determined according to said estimated resistance change.

14. The electrophotographic printer of claim 10, also comprising:

a developing roller for applying said toner to said photosensitive drum; and a developing power supply coupled to said developing roller, for supplying to said developing roller a developing voltage determined according to said estimated resistance change.

15. The electrophotographic printer of claim 10, also comprising:

a fusing roller for fusing said toner to said printing media; and a fusing temperature control unit coupled to said fusing roller, for holding said fusing roller at a fusing temperature determined according to said estimated resistance change.

16. The electrophotographic printer of claim 15, wherein different fusing temperatures are determined for different types of said printing media.

17. The electrophotographic printer of claim 10, further comprising:

a discharging unit for discharging said printing media after said printing media have passed said transfer roller; and a discharging power supply coupled to said discharging unit, for supplying to said discharging unit a discharging potential determined according to said estimated resistance change.

18. The electrophotographic printer of claim 17, wherein different discharging voltages are determined for different types of said printing media.

* * * * *